US008550770B2

(12) United States Patent
Hofer et al.

(10) Patent No.: US 8,550,770 B2
(45) Date of Patent: Oct. 8, 2013

(54) SUPERSONIC COMPRESSOR STARTUP SUPPORT SYSTEM

(75) Inventors: Douglas Carl Hofer, Clifton Park, NY (US); Dhananjayarao Gottapu, Bangalore (IN)

(73) Assignee: General Electric Company, Niskayuna, NY (US)

( * ) Notice: Subject to any disclaimer, the term of this patent is extended or adjusted under 35 U.S.C. 154(b) by 242 days.

(21) Appl. No.: 13/117,871

(22) Filed: May 27, 2011

(65) Prior Publication Data

US 2012/0301270 A1 Nov. 29, 2012

(51) Int. Cl.
*F04D 21/00* (2006.01)

(52) U.S. Cl.
USPC ..... 415/1

(58) Field of Classification Search
USPC ..... 415/1
See application file for complete search history.

(56) References Cited

U.S. PATENT DOCUMENTS

| | | | |
|---|---|---|---|
| 2,925,952 | A | 2/1960 | Garve |
| 4,012,166 | A | 3/1977 | Kaesser et al. |
| 4,199,296 | A | 4/1980 | de Chair |
| 4,463,772 | A | 8/1984 | Ball |
| 4,620,679 | A | 11/1986 | Karanian |
| 4,704,861 | A | 11/1987 | Mowill |
| 5,525,038 | A | 6/1996 | Sharma et al. |
| 5,881,758 | A | 3/1999 | Koncsek et al. |
| 6,358,003 | B2 | 3/2002 | Schlechtriem |
| 6,428,271 | B1 | 8/2002 | Ress, Jr. et al. |
| 6,488,469 | B1 | 12/2002 | Yousser et al. |
| 7,070,388 | B2 | 7/2006 | Meng et al. |
| 7,293,955 | B2 | 11/2007 | Lawlor et al. |
| 7,296,396 | B1 | 11/2007 | Wilson et al. |
| 7,334,990 | B2 | 2/2008 | Lawlor et al. |
| 7,337,606 | B2 | 3/2008 | Brouillette et al. |
| 7,434,400 | B2 | 10/2008 | Lawlor et al. |
| 2009/0107557 | A1 | 4/2009 | Conners |

(Continued)

FOREIGN PATENT DOCUMENTS

| | | | |
|---|---|---|---|
| EP | 1126133 | A2 | 8/2001 |
| GB | 885661 | | 12/1961 |
| WO | 2009025803 | A1 | 2/2009 |

OTHER PUBLICATIONS

Shawn P. Lawlor and Peter Baldwin, Conceptual Design of a Supersonic CO2 Compressor, Proceedings of ASME 2005, ASME Turbo Expo 2005, Jun. 6-9, 2005, 8 pages, Ramgen Power Systems, Bellevue, WA.

(Continued)

*Primary Examiner* — Nathaniel Wiehe
*Assistant Examiner* — Brian O Peters
(74) *Attorney, Agent, or Firm* — Andrew J. Caruso

(57) ABSTRACT

A supersonic compressor includes a fluid inlet, fluid outlet, and a fluid conduit extending therebetween with a supersonic compressor rotor disposed therein. The supersonic compressor rotor includes a first endwall and a plurality of vanes coupled thereto. Each pair of the vanes defines a fluid flow channel. The fluid flow channel defines a flow channel inlet opening and a flow channel outlet opening and includes a throat portion. The supersonic compressor rotor also includes a second endwall and at least one axially translatable fluid control device positioned adjacent to the rotor. The axially translatable fluid control device is configured to obstruct the throat portion and includes at least one axially translatable protrusion insertable into at least a portion of the throat portion.

20 Claims, 11 Drawing Sheets

(56) References Cited

U.S. PATENT DOCUMENTS

| | | | | |
|---|---|---|---|---|
| 2009/0196731 | A1 | 8/2009 | Lawlor | |
| 2010/0005763 | A1 | 1/2010 | Bloom | |
| 2010/0043389 | A1 | 2/2010 | Conners | |
| 2011/0142592 | A1 * | 6/2011 | Nagel et al. | 415/1 |

OTHER PUBLICATIONS

H.J. Lichtfuss, H. Starken, Supersonic Cascade Flow, Progress in Aerospace Sciences vol. 15, 1974, pp. 37-149.

M. F. El-Dosoky, A. Rona and J. P. Gostelow, An Analytical Model for Over-Shroud Leakage Losses in a Shrouded Turbine Stage, ASME Turbo Expo 2007, Power for Land, Sea and Air, GT2007, May 2007, pp. 1-10, Montreal Canada.

Allan D. Grosvenor, David A. Taylor, Jonathan R. Bucher, Michael J. Aarnio, Paul M. Brown, Robert D. Draper, Shawn P. Lawlor, Measured and Predicted Performance of a High Pressure Ratio Supersonic Compressor Rotor, ASME Turbo Expo 2008, Power for Land, Sea and Air, GT2008, Jun. 2008, pp. 1-12, Berlin, Germany.

* cited by examiner

SUPERSONIC COMPRESSOR STARTUP SUPPORT SYSTEM

BACKGROUND

The subject matter described herein relates generally to supersonic compressor systems and, more particularly, to a supersonic compressor rotor for use with a supersonic compressor system.

At least some known supersonic compressor systems include a drive assembly, a drive shaft, and at least one supersonic compressor rotor for compressing a fluid. The drive assembly is coupled to the supersonic compressor rotor with the drive shaft to rotate the drive shaft and the supersonic compressor rotor.

Known supersonic compressor rotors include a plurality of vanes coupled to a rotor disk. Each vane is oriented circumferentially about the rotor disk and defines a flow channel between adjacent vanes. At least some known supersonic compressor rotors include a supersonic compression ramp that is coupled to the rotor disk. Known supersonic compression ramps are positioned within the flow path to form a throat region and are configured to form a compression wave within the flow path.

During starting operation of known supersonic compressor systems, the drive assembly rotates the supersonic compressor rotor at an initially low speed and accelerates the rotor to a high rotational speed. A fluid is channeled to the supersonic compressor rotor such that the fluid is characterized by a velocity that is initially subsonic with respect to the supersonic compressor rotor at the flow channel inlet and then, as the rotor accelerates, the fluid is characterized by a velocity that is supersonic with respect to the supersonic compressor rotor at the flow channel inlet. In known supersonic compressor rotors, as fluid is channeled through the flow channel, the supersonic compressor ramp causes formation of a system of oblique shockwaves within a converging portion of the flow channel and a normal shockwave in a diverging portion of the flow channel. A throat region is defined in the narrowest portion of the flow channel between the converging and diverging portions. Wider throat regions facilitate establishing supersonic flow in the throat region during startup, but, decrease performance at steady-state. Narrower throat regions facilitate steady-state performance, but, increase a difficulty of establishing the supersonic flow in the throat region. Moreover, many known supersonic compressors have fixed throat geometries. Known supersonic compressor systems are described in, for example, U.S. Pat. Nos. 7,334,990 and 7,293,955 filed Mar. 28, 2005 and Mar. 23, 2005 respectively, and United States Patent Application 2009/0196731 filed Jan. 16, 2009.

BRIEF DESCRIPTION OF THE INVENTION

In one aspect, a supersonic compressor is provided. The supersonic compressor includes a fluid inlet, fluid outlet, and a fluid conduit extending therebetween with a supersonic compressor rotor disposed therein. The supersonic compressor rotor includes a first endwall and a plurality of vanes coupled thereto. Each pair of the vanes defines a fluid flow channel. The fluid flow channel defines a flow channel inlet opening and a flow channel outlet opening and includes a throat portion. The supersonic compressor rotor also includes a second endwall and at least one axially translatable fluid control device positioned adjacent to the rotor. The axially translatable fluid control device is configured to obstruct the throat portion and includes at least one axially translatable protrusion insertable into at least a portion of the throat portion.

In another aspect, a startup support system for a supersonic compressor is provided. The supersonic compressor includes at least one fluid inlet, at least one fluid outlet, a fluid conduit extending therebetween, at least one supersonic compressor rotor disposed within the fluid conduit, and a flow channel inlet opening and a flow channel outlet opening with a throat portion therebetween. The startup support system includes at least one axially translatable fluid control device positioned adjacent to the rotor. The axially translatable fluid control device is configured to at least partially obstruct fluid flow through the throat portion. The at least one axially translatable fluid control device includes at least one axially translatable protrusion insertable into at least a portion of the throat portion In yet another aspect, a method for starting a supersonic compressor is provided. The method includes providing a supersonic compressor. The supersonic compressor includes a fluid inlet coupled in fluid communication with at least one fluid source, a fluid outlet, and at least one supersonic compressor rotor. The at least one supersonic compressor rotor includes a first endwall, and a plurality of vanes coupled to the first endwall. Each pair of the plurality of vanes defines a fluid flow channel extending therethrough. The fluid flow channel defines a flow channel inlet opening and a flow channel outlet opening. The fluid flow channel includes a throat portion. The at least one supersonic compressor rotor also includes a second endwall and at least one axially translatable fluid control device positioned adjacent to the rotor. The axially translatable fluid control device is configured to at least partially obstruct the throat portion. The at least one axially translatable fluid control device includes at least one axially translatable protrusion insertable into at least a portion of the throat portion. The method also includes axially moving the at least one axially translatable fluid control device to a first position that substantially opens the throat portion during a starting mode of operation of the supersonic compressor.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

Figure 1:
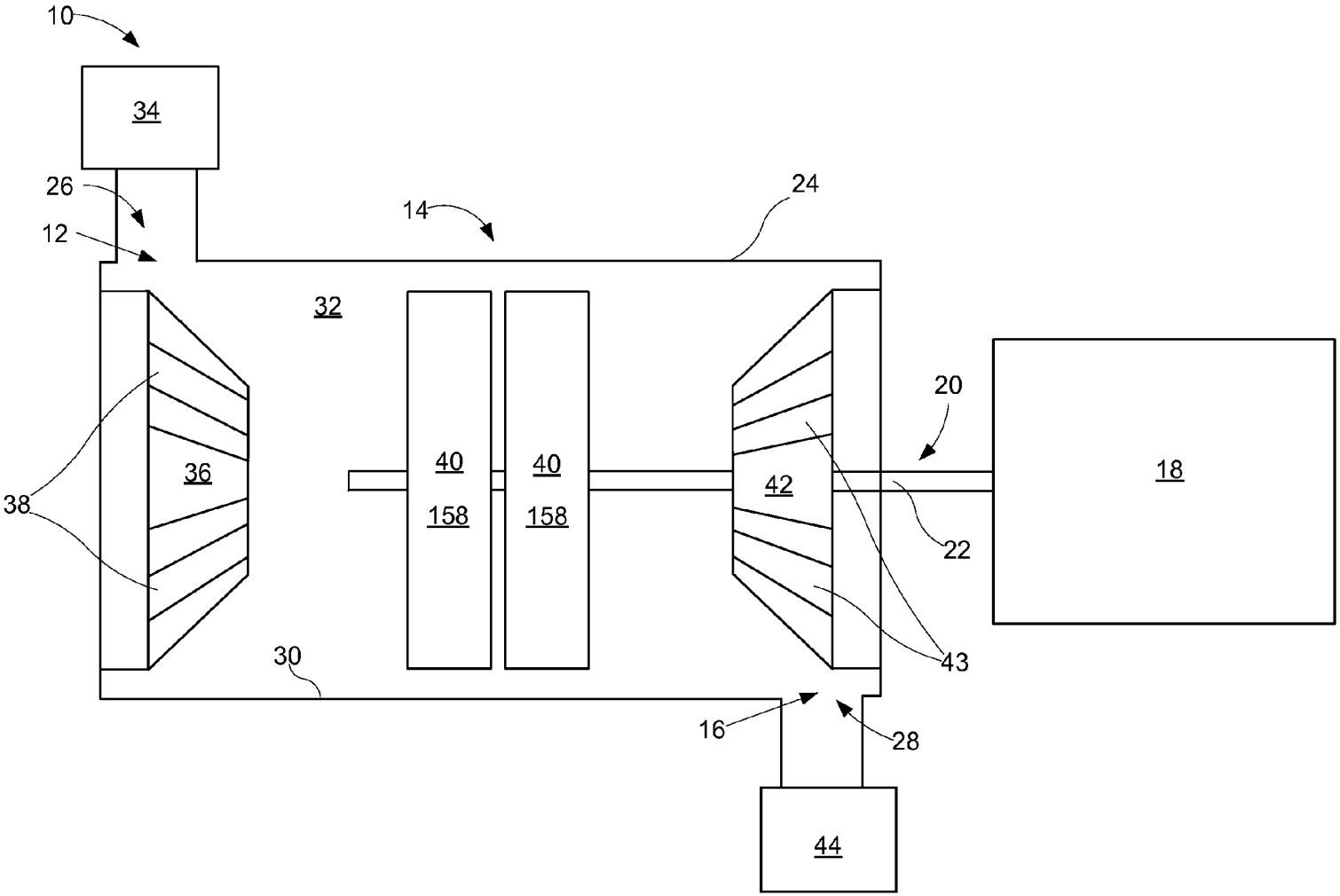
FIG. 1 is a schematic view of an exemplary supersonic compressor system.

Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

DETAILED DESCRIPTION OF THE INVENTION

In the following specification and the claims, which follow, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the term "supersonic compressor rotor" refers to a compressor rotor comprising a supersonic compression ramp disposed within a fluid flow channel of the supersonic compressor rotor. Moreover, supersonic compressor rotors are "supersonic" because they are designed to rotate about an axis of rotation at high speeds such that a moving fluid, for example a moving gas, encountering the rotating supersonic compressor rotor at a supersonic compression ramp disposed within a flow channel of the rotor, is said to have a relative fluid velocity which is supersonic. The relative fluid velocity can be defined in terms of the vector sum of the rotor velocity at the supersonic compression ramp and the fluid velocity just prior to encountering the supersonic compression ramp. This relative fluid velocity is at times referred to as the "local supersonic inlet velocity", which in certain embodiments is a combination of an inlet gas velocity and a tangential speed of a supersonic compression ramp disposed within a flow channel of the supersonic compressor rotor. The supersonic compressor rotors are engineered for service at very high tangential speeds, for example tangential speeds in a range of 300 meters/second to 800 meters/second.

The exemplary systems and methods described herein overcome disadvantages of known supersonic compressors by providing a supersonic compressor rotor with a variable throat geometry that facilitates formation and maintenance of normal shockwaves in a proper position within a fluid flow channel. More specifically, the embodiments described herein include a supersonic compression rotor with a fluid control device that modulates a size of the throat area during starting operations.

FIG. 1 is a schematic view of an exemplary supersonic compressor system 10. In the exemplary embodiment, supersonic compressor system 10 includes an intake section 12, a compressor section 14 coupled downstream from intake section 12, a discharge section 16 coupled downstream from compressor section 14, and a drive assembly 18. Compressor section 14 is coupled to drive assembly 18 by a rotor assembly 20 that includes a drive shaft 22. In the exemplary embodiment, each of intake section 12, compressor section 14, and discharge section 16 are positioned within a compressor housing 24. More specifically, compressor housing 24 includes a fluid inlet 26, a fluid outlet 28, and an inner surface 30 that defines a cavity 32. Cavity 32 extends between fluid inlet 26 and fluid outlet 28 and is configured to channel a fluid from fluid inlet 26 to fluid outlet 28. Each of intake section 12, compressor section 14, and discharge section 16 are positioned within cavity 32. Alternatively, intake section 12 and/or discharge section 16 may not be positioned within compressor housing 24.

In the exemplary embodiment, fluid inlet 26 is configured to channel a flow of fluid from a fluid source 34 to intake section 12. The fluid may be any fluid such as, for example a gas, a gas mixture, and/or a liquid-gas mixture. Intake section 12 is coupled in flow communication with compressor section 14 for channeling fluid from fluid inlet 26 to compressor section 14. Intake section 12 is configured to condition a fluid flow having one or more predetermined parameters, such as a velocity, a mass flow rate, a pressure, a temperature, and/or any suitable flow parameter. In the exemplary embodiment, intake section 12 includes an inlet guide vane assembly 36 that is coupled between fluid inlet 26 and compressor section 14 for channeling fluid from fluid inlet 26 to compressor section 14. Inlet guide vane assembly 36 includes one or more inlet guide vanes 38 that are coupled to compressor housing 24 and are stationary with respect to compressor section 14.

Compressor section 14 is coupled between intake section 12 and discharge section 16 for channeling at least a portion of fluid from intake section 12 to discharge section 16. In the exemplary embodiment, compressor section 14 includes at least one supersonic compressor rotor 40 that is rotatably coupled to drive shaft 22. In the embodiment shown, a pair of concentric drive shafts (not shown) which includes drive shaft 22 can be used to drive supersonic compressor rotors 40 (158), the concentric drive shafts being configured to drive the pair of supersonic compressor rotors shown in opposite senses (i.e., in operation the supersonic compressor rotors are counter-rotating). Alternatively, supersonic compressor 10 may also include at least one alternative supersonic compressor rotor 158 (discussed further below). Supersonic compressor rotor 40 is configured to increase a pressure of fluid, reduce a volume of fluid, and/or increase a temperature of fluid being channeled to discharge section 16. Discharge section 16 includes an outlet guide vane assembly 42 that is coupled between compressor section 14 and fluid outlet 28 for channeling fluid from supersonic compressor rotor 40 (158) to fluid outlet 28. Outlet guide vane assembly 42 includes one or more outlet guide vanes 43 that are coupled to compressor housing 24 and are stationary with respect to compressor section 14. Fluid outlet 28 is configured to channel fluid from outlet guide vane assembly 42 and/or supersonic compressor 10 to an output system 44 such as, for example, a turbine engine system, a fluid treatment system, and/or a fluid storage system. Drive assembly 18 is configured to rotate drive shaft 22 to cause supersonic compressor rotor 40 to rotate. As described above, in the configuration depicted in FIG. 1, a pair of concentric drive shafts may be employed to counter-rotate a pair of supersonic compressor rotors, for example, a pair of supersonic compressor rotors arrayed in series.

During operation, intake section 12 channels fluid from fluid source 34 towards compressor section 14. Compressor section 14 compresses the fluid and discharges the compressed fluid towards discharge section 16. Discharge section 16 channels the compressed fluid from compressor section 14 to output system 44 through fluid outlet 28.

Figure 2:
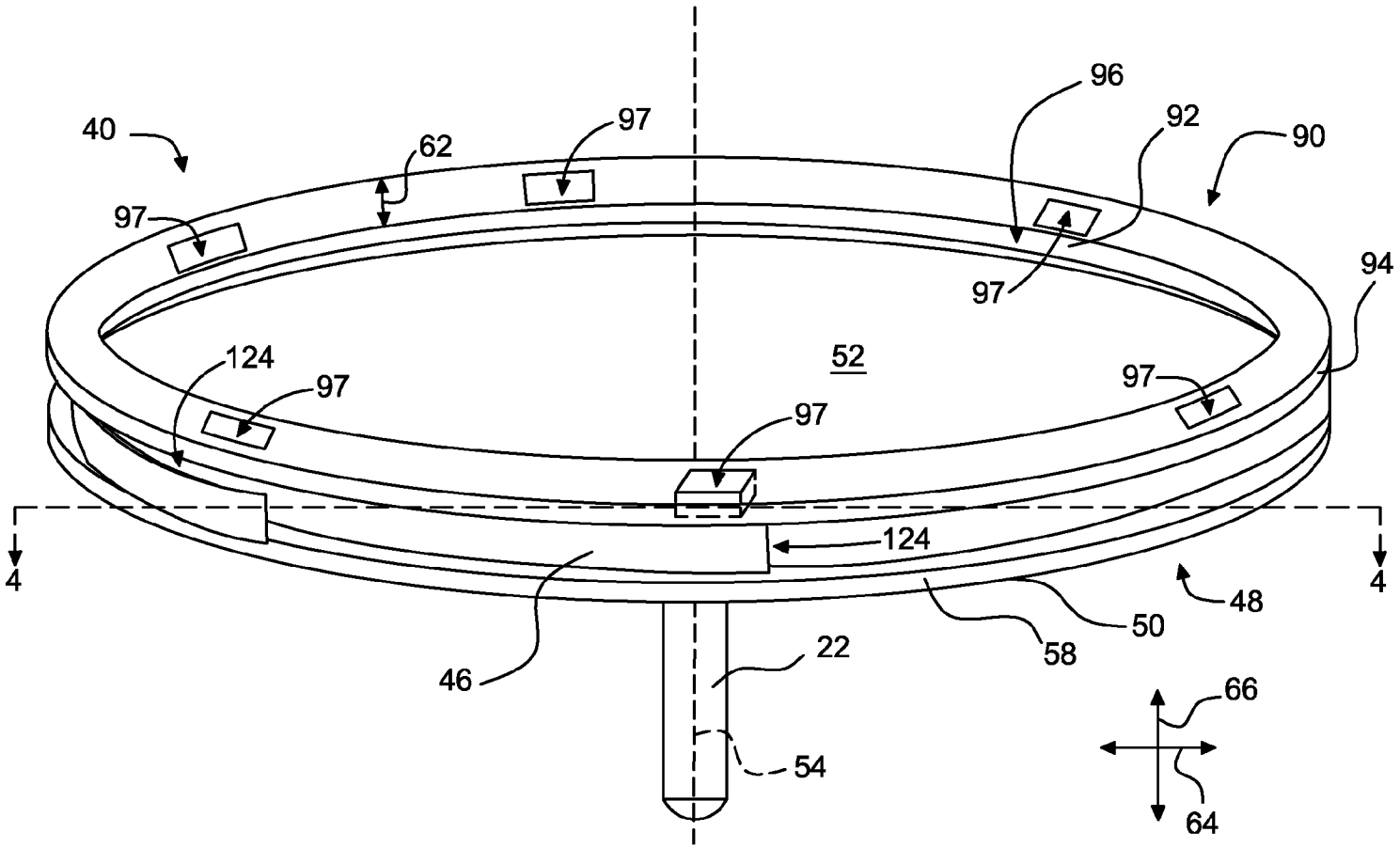
FIG. 2 is a perspective view of an exemplary supersonic compressor rotor that may be used with the supersonic compressor shown in FIG. 1.
Figure 3:
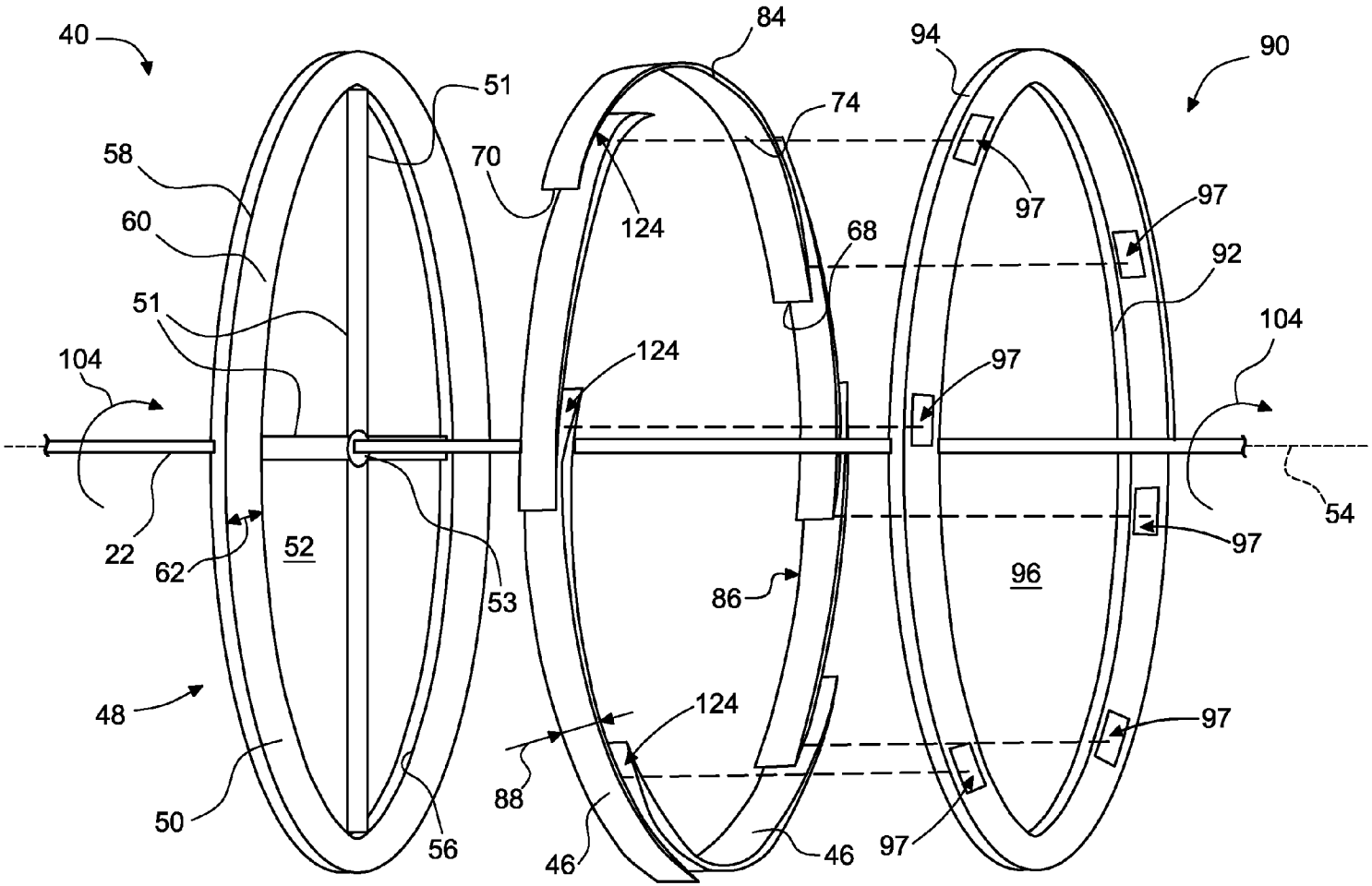
FIG. 3 is an exploded perspective view of the supersonic compressor rotor shown in FIG. 2.
Figure 4:
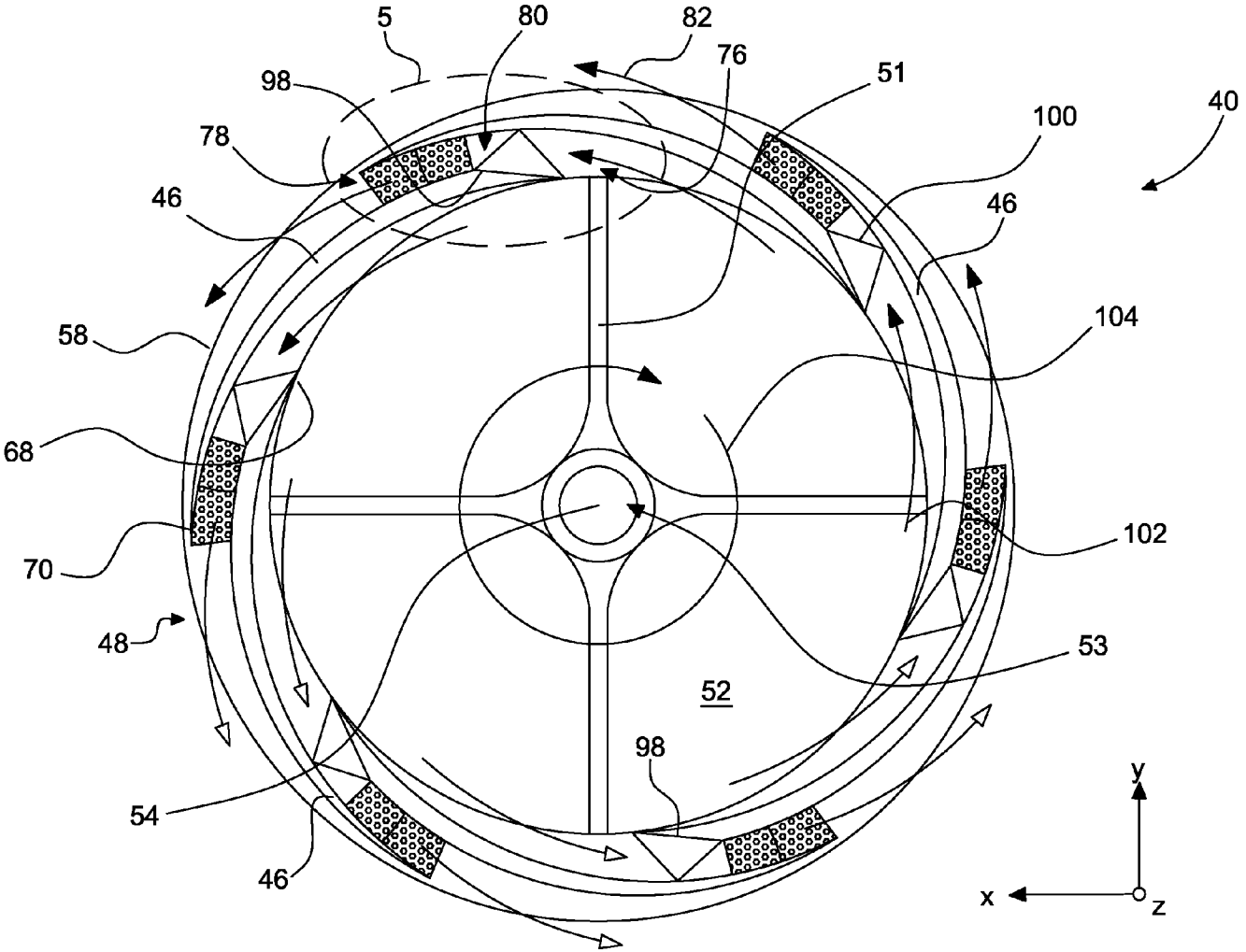
FIG. 4 is a cross-sectional view of the supersonic compressor rotor shown in FIG. 2 and taken along line 4-4.

FIG. 2 is a perspective view of an exemplary supersonic compressor rotor 40. FIG. 3 is an exploded perspective view of supersonic compressor rotor 40. FIG. 4 is a cross-sectional view of supersonic compressor rotor 40 taken along sectional line 4-4 shown in FIG. 2. Identical components shown in FIG. 3 and FIG. 4 are labeled with the same reference numbers used in FIG. 2. For purposes of clarity, FIG. 4 shows an x-axis to illustrate a first radial dimension, a y-axis to illustrate a second radial dimension that is perpendicular to the x-axis, and a z-axis to illustrate an axial dimension that is perpendicular to the x-axis and the y-axis. These reference axes will be used hereon. In FIG. 4, the z-axis is directed out of the page. In the exemplary embodiment, supersonic compressor rotor 40 includes a plurality of vanes 46 that are coupled to a rotor disk 48. More specifically, supersonic compressor rotor 40 includes six vanes 46 as shown in the exemplary embodiment for clarity. Alternatively, supersonic compressor rotor 40 includes any number of vanes 46 that enable operation of supersonic compressor 10 as described herein.

Rotor disk 48 includes an annular disk body 50 that defines an inner cavity 52 extending generally axially through disk body 50 along a centerline axis 54. Disk body 50 includes a radially inner surface 56, a radially outer surface 58, and an endwall 60. Radially inner surface 56 defines inner cavity 52. Inner cavity 52 has a substantially cylindrical shape and is oriented about centerline axis 54. Drive shaft 22 is rotatably coupled to rotor disk 48 via a plurality of rotor support struts 51 that define an aperture 53 through which drive shaft 22 is inserted. Endwall 60 extends radially outwardly from inner cavity 52 and between radially inner surface 56 and radially outer surface 58. Endwall 60 includes a width 62 defined in a radial direction 64 that is oriented perpendicular to centerline axis 54.

In the exemplary embodiment, each vane 46 is coupled to endwall 60 and extends outwardly from endwall 60 in an axial direction 66 that is generally parallel to centerline axis 54. Each vane 46 includes an inlet edge 68 and an outlet edge 70. Inlet edge 68 is positioned adjacent radially inner surface 56. Outlet edge 70 is positioned adjacent radially outer surface 58. In the exemplary embodiment, supersonic compressor rotor 40 includes a pair 74 of vanes 46. Each vane 46 is oriented to define an inlet opening 76, an outlet opening 78, and a flow channel 80 between each pair 74 of adjacent vanes 46. Flow channel 80 extends between inlet opening 76 and outlet opening 78 and defines a flow path, represented by arrow 82, (shown in FIG. 4) from inlet opening 76 to outlet opening 78. Flow path 82 is oriented generally parallel to vane 46. Flow channel 80 is sized, shaped, and oriented to channel fluid along flow path 82 from inlet opening 76 to outlet opening 78 in radial direction 64. Inlet opening 76 is defined between inlet edge 68 and adjacent vane 46. Outlet opening 78 is defined between outlet edges 70 and adjacent vanes 46. Each vane 46 extends radially between inlet edge 68 and outlet edge 70 such that vane 46 extends between radially inner surface 56 and radially outer surface 58. Also, each vane 46 includes an outer surface 84 and an opposite inner surface 86. Vane 46 extends between outer surface outer surface 84 and inner surface 86 to define an axial height 88 of flow channel 80.

Referring to FIG. 2 and FIG. 3, in the exemplary embodiment, a shroud assembly 90 is coupled to outer surface 84 of each vane 46 such that flow channel 80 (shown in FIG. 4) is defined between shroud assembly 90 and endwall 60. Shroud assembly 90 includes an inner edge 92 and an outer edge 94. Inner edge 92 defines a substantially cylindrical opening 96. Shroud assembly 90 is oriented coaxially with rotor disk 48, such that inner cylindrical cavity 52 is concentric with opening 96. Shroud assembly 90 is coupled to each vane 46 such that inlet edge 68 of vane 46 is positioned adjacent inner edge 92 of shroud assembly 90, and outlet edge 70 of vane 46 is positioned adjacent outer edge 94 of shroud assembly 90.

Also, in the exemplary embodiment, shroud assembly 90 defines a plurality of perforations, or penetrations 97. Each penetration 97 extends through shroud assembly 90 to a throat portion 124 of an associated flow channel 80. Throat portion 124 is described in more detail below. Therefore, the number of penetrations 97 equals the number of vanes 46 that equals the number of flow channels 80 and associated throat regions 124.

Referring to FIG. 4, in the exemplary embodiment, at least one supersonic compression ramp 98 is positioned within flow channel 80. Supersonic compression ramp 98 is positioned between inlet opening 76 and outlet opening 78, and is sized, shaped, and oriented to enable one or more compression waves 100 to form within flow channel 80.

During operation of supersonic compressor rotor 40, intake section 12 (shown in FIG. 1) channels a fluid 102 towards inlet opening 76 of flow channel 80. Fluid 102 has a first velocity, i.e., an approach velocity, just prior to entering inlet opening 76. Supersonic compressor rotor 40 is rotated about centerline axis 54 at a second velocity, i.e., a rotational velocity, represented by directional arrow 104, such that fluid 102 entering flow channel 80 has a third velocity, i.e., an inlet velocity at inlet opening 76 that is supersonic relative to vanes 46. As fluid 102 is channeled through flow channel 80 at a supersonic velocity, supersonic compression ramp 98 enables compression waves 100 to form within flow channel 80 to facilitate compressing fluid 102, such that fluid 102 includes an increased pressure and temperature, and/or includes a reduced volume at outlet opening 78.

Figure 5:
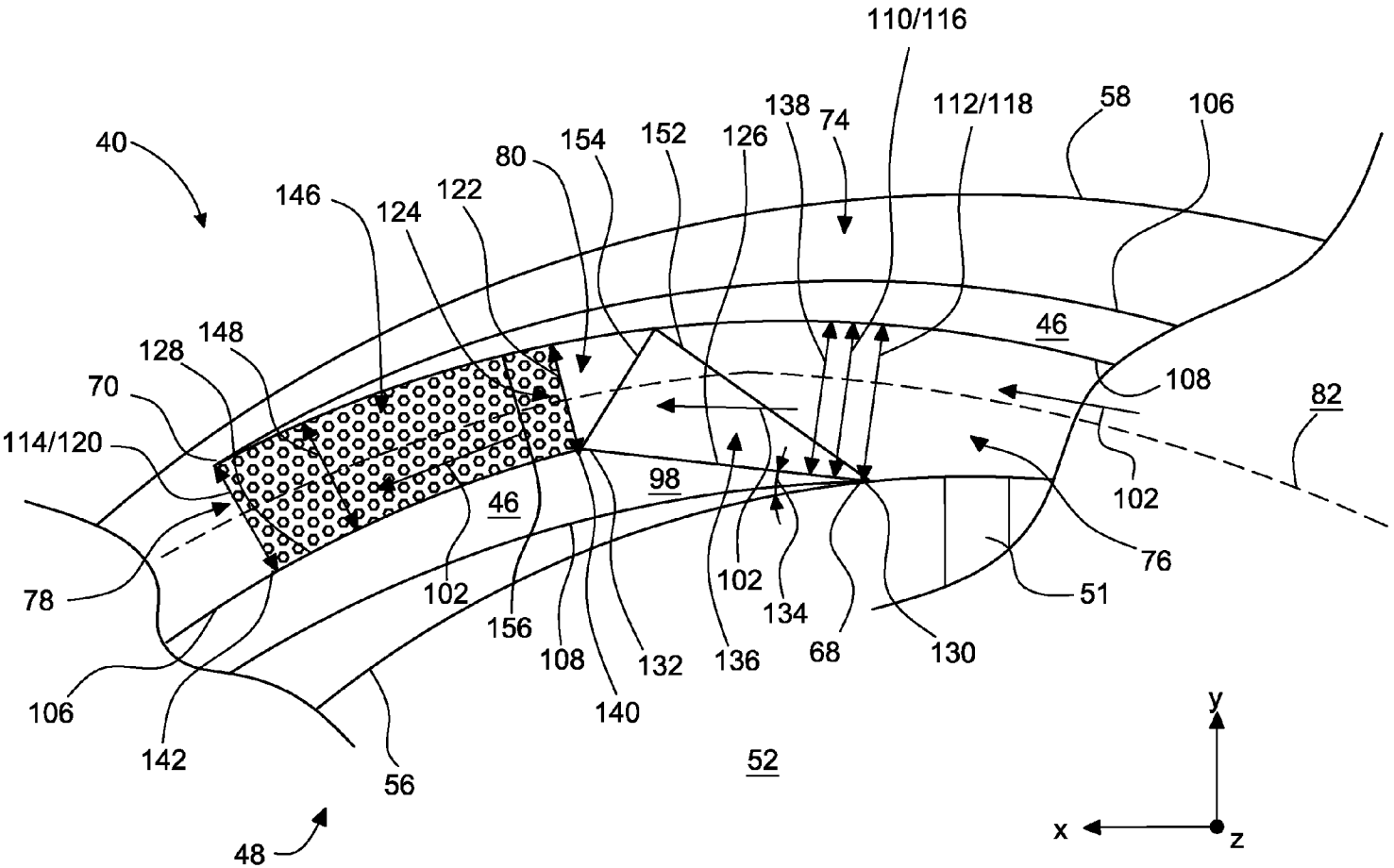
FIG. 5 is an enlarged cross-section view of a portion of the supersonic compressor rotor shown in FIG. 4 and taken along area 5.

FIG. 5 is an enlarged cross-sectional view of a portion of supersonic compressor rotor 40 taken along area 5 shown in FIG. 4. Identical components shown in FIG. 5 are labeled with the same reference numbers used in FIG. 2 and FIG. 4. For purposes of clarity, FIG. 5 shows an x-axis to illustrate a first radial dimension, a y-axis to illustrate a second radial dimension that is perpendicular to the x-axis, and a z-axis to illustrate an axial dimension that is perpendicular to the x-axis and the y-axis. In FIG. 5, the z-axis is directed out of the page. In the exemplary embodiment, each vane 46 includes a first, or pressure side 106 and an opposing second, or suction side 108. Each pressure side 106 and suction side 108 extends between inlet edge 68 and outlet edge 70.

In the exemplary embodiment, each vane 46 is spaced circumferentially about inner cylindrical cavity 52 such that flow channel 80 is oriented generally radially between inlet opening 76 and outlet opening 78. Each inlet opening 76 extends between a pressure side 106 and an adjacent suction side 108 of vane 46 at inlet edge 68. Each outlet opening 78 extends between pressure side 106 and an adjacent suction side 108 at outlet edge 70, such that flow path 82 is defined radially outwardly from radially inner surface 56 to radially outer surface 58 in radial direction 64. Alternatively, adjacent vanes 46 may be oriented such that inlet opening 76 is defined at radially outer surface 58 and outlet opening 78 is defined at radially inner surface 56 such that flow path 82 is defined radially inwardly from radially outer surface 58 to radially inner surface 56. In the exemplary embodiment, flow channel 80 includes a circumferential width 110 that is defined between pressure side 106 and adjacent suction side 108 and is perpendicular to flow path 82. Inlet opening 76 has a first circumferential width 112 that is larger than a second circumferential width 114 of outlet opening 78. Alternatively, first circumferential width 112 of inlet opening 76 may be less than, or equal to, second circumferential width 114 of outlet opening 78. In the exemplary embodiment, each vane 46 is formed with an arcuate shape and is oriented such that flow channel 80 is defined with a spiral shape and generally converges inwardly between inlet opening 76 to outlet opening 78.

In the exemplary embodiment, flow channel 80 defines a cross-sectional area 116 that varies along flow path 82. Cross-sectional area 116 of flow channel 80 is defined perpendicularly to flow path 82 and is equal to circumferential width 110 of flow channel multiplied by axial height 88 (shown in FIG. 3) of flow channel 80. Flow channel 80 includes a first area, i.e., an inlet cross-sectional area 118 at inlet opening 76, a second area, i.e., an outlet cross-sectional area 120 at outlet opening 78, and a third area, i.e., a minimum cross-sectional area 122 that is defined between inlet opening 76 and outlet opening 78. In the exemplary embodiment, minimum cross-sectional area 122 is less than inlet cross-sectional area 118 and outlet cross-sectional area 120. In one embodiment, minimum cross-sectional area 122 is equal to outlet cross-sectional area 120, wherein each of outlet cross-sectional area 120 and minimum cross-sectional area 122 is less than inlet cross-sectional area 118.

In the exemplary embodiment, supersonic compression ramp 98 is coupled to pressure side 106 of vane 46 and defines a throat region 124 of flow channel 80. Throat region 124 defines minimum cross-sectional area 122 of flow channel 80. In an alternative embodiment, supersonic compression ramp 98 may be coupled to suction side 108 of vane 46, endwall 60, and/or shroud assembly 90. In a further alternative embodiment, supersonic compressor rotor 40 includes a plurality of supersonic compression ramps 98 that are each coupled to pressure side 106, suction side 108, endwall 60, and/or shroud assembly 90. In such an embodiment, each supersonic compression ramp 98 may define a throat region 124. Alternatively, two or more supersonic compressor ramps may define a throat region within a flow channel of a supersonic compressor rotor.

In the exemplary embodiment, throat region 124 defines minimum cross-sectional area 122 that is less than inlet cross-sectional area 118 such that flow channel 80 has an area ratio defined as a ratio of inlet cross-sectional area 118 divided by minimum cross-sectional area 122 of between about 1.01 and 1.10. In one embodiment, the area ratio is between about 1.07 and 1.08.

In the exemplary embodiment, supersonic compression ramp 98 includes a compression surface 126 and a diverging surface 128. Compression surface 126 includes a first, or leading edge 130 and a second, or trailing edge 132. Leading edge 130 is positioned closer to inlet opening 76 than trailing edge 132. Compression surface 126 extends between leading edge 130 and trailing edge 132 and is oriented at an oblique angle 134 define between radially inner surface 56 and compression surface 126. Compression surface 126 converges towards an adjacent suction side 108 such that a compression region 136 is defined between leading edge 130 and trailing edge 132. Compression region 136 includes a cross-sectional area 138 of flow channel 80 that is reduced along flow path 82 from leading edge 130 to trailing edge 132. Trailing edge 132 of compression surface 126 defines throat region 124.

Diverging surface 128 is coupled to compression surface 126 and extends downstream from compression surface 126 towards outlet opening 78. Diverging surface 128 includes a first end 140 and a second end 142 that is closer to outlet opening 78 than first end 140. First end 140 of diverging surface 128 is coupled to trailing edge 132 of compression surface 126. Diverging surface 128 extends between first end 140 and second end 142. Diverging surface 128 defines a diffusion region 146 that includes a diverging cross-sectional area 148 that increases from second end 142 of compression surface 126 to outlet opening 78. Diffusion region 146 extends from throat region 124 to outlet opening 78. In an alternative embodiment, supersonic compression ramp does not include diverging surface 128. In this alternative embodiment, trailing edge 132 of compression surface 126 is positioned adjacent outlet edge 70 of vane 46 such that throat region 124 is defined adjacent outlet opening 78.

During operation of supersonic compressor rotor 40, fluid 102 is channeled from inner cylindrical cavity 52 into inlet opening 76 at a supersonic velocity with respect to rotor disk 48. Fluid 102 entering flow channel 80 from inner cylindrical cavity 52 contacts leading edge 130 of supersonic compression ramp 98 to form a first oblique shockwave 152. Compression region 136 of supersonic compression ramp 98 is configured to cause first oblique shockwave 152 to be oriented at an oblique angle with respect to flow path 82 from leading edge 130 towards adjacent vane 46, and into flow channel 80. As first oblique shockwave 152 contacts adjacent vane 46, a second oblique shockwave 154 is reflected from adjacent vane 46 at an oblique angle with respect to flow path 82, and towards throat region 124 of supersonic compression ramp 98. In one embodiment, compression surface 126 is oriented to cause second oblique shockwave 154 to extend from first oblique shockwave 152 at adjacent vane 46 to trailing edge 132 that defines throat region 124. Supersonic compression ramp 98 is configured to cause each first oblique shockwave 152 and second oblique shockwave 154 to form within compression region 136.

As fluid 102 passes through compression region 136, a velocity of fluid 102 is reduced as fluid 102 passes through each first oblique shockwave 152 and second oblique shockwave 154. In addition, a pressure of fluid 102 is increased, and a volume of fluid 102 is decreased. In one embodiment, supersonic compression ramp 98 is configured to condition fluid 102 to have an outlet velocity at outlet opening 78 that is supersonic with respect to rotor disk 48. In an alternative embodiment, supersonic compression ramp 98 is configured to cause a normal shockwave 156 to form downstream of throat region 124 and within flow channel 80. Normal shockwave 156 is a shockwave oriented perpendicular to flow path 82 that reduces a velocity of fluid 102 to a subsonic velocity with respect to rotor disk 48 as fluid passes through normal shockwave 156.

Figure 6:
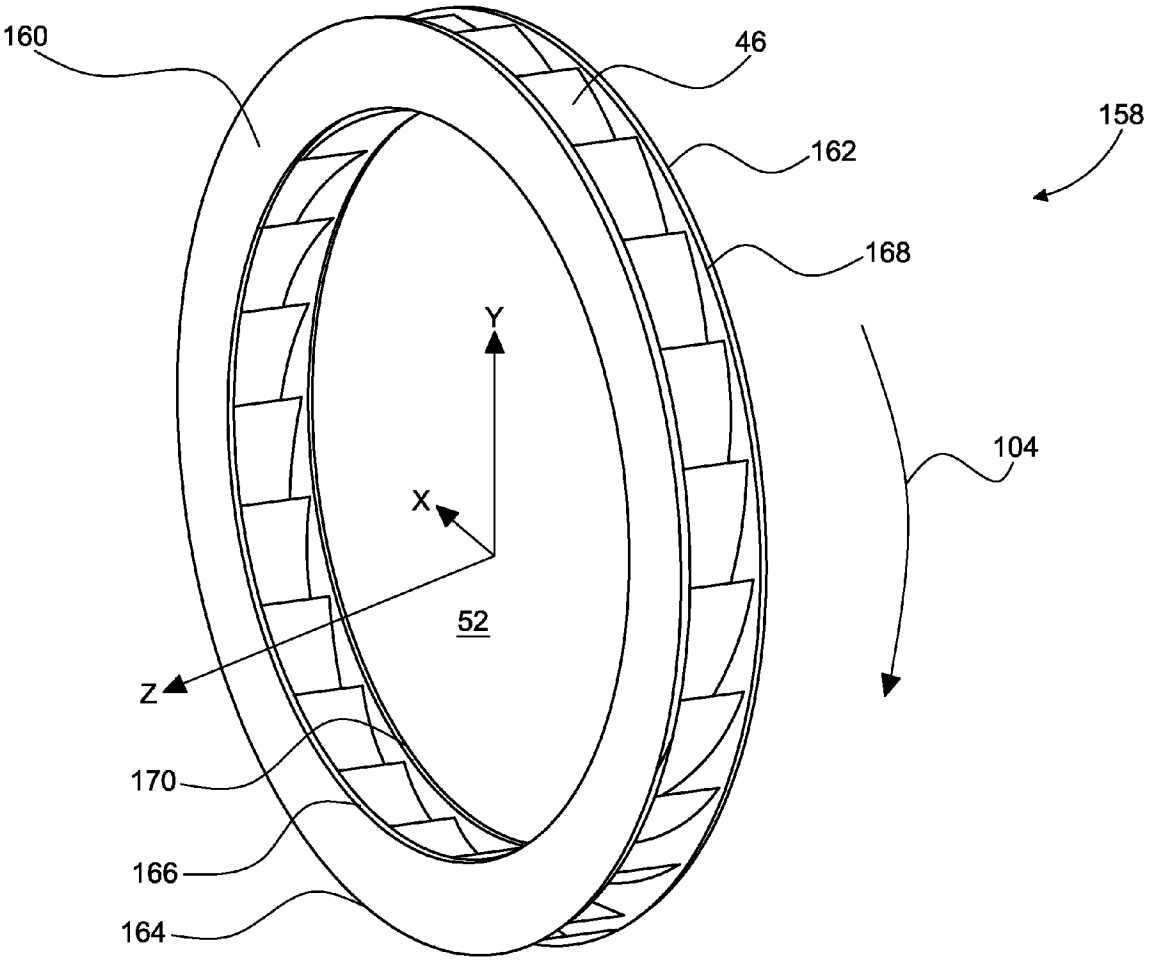
FIG. 6 is a perspective view of a portion of an alternative supersonic compressor rotor that may be used with the supersonic compressor shown in FIG. 1.

FIG. 6 is a perspective view of a portion of an alternative supersonic compressor rotor 158 that may be used with supersonic compressor system 10 (shown in FIG. 1). For purposes of clarity, FIG. 6 shows an x-axis to illustrate a first radial dimension, a y-axis to illustrate a second radial dimension that is perpendicular to the x-axis, and a z-axis to illustrate an axial dimension that is perpendicular to the x-axis and the y-axis. Also, in FIG. 6, rotor support struts 51, aperture 53, and shaft 22 (all shown in FIG. 3) are not shown for clarity. Moreover, in FIG. 6 and hereon, shroud assembly 90 is referred to as first endwall 160 and endwall 60 is referred to as second endwall 162. Unless otherwise indicated, identical components shown in FIG. 6 are labeled with the same reference numbers used in FIGS. 1-5.

In the exemplary embodiment, supersonic compressor rotor 158 includes at least twenty vanes 46, as compared to six vanes 46 for rotor 40 (shown in FIGS. 2, 3, and 4). Supersonic compressor rotor 158 may include any number of vanes 46 that enable operation of supersonic compressor system 10 as described herein. Vanes 46 are coupled to both first and second endwalls 160 and 162, respectively. First endwall 160 includes a first outer periphery 164 circumferentially defined by outer edge 94 (shown in FIG. 3) and a first inner periphery 166 circumferentially defined by inner edge 92 (shown in FIG. 3). Second endwall 162 includes a second outer periphery 168 circumferentially defined by outer surface 58 (shown in FIG. 3) and a second inner periphery 170 circumferentially defined by inner surface 56 (shown in FIG. 3). Supersonic compressor rotor 158 is rotated as shown by directional arrow 104.

Figure 7:
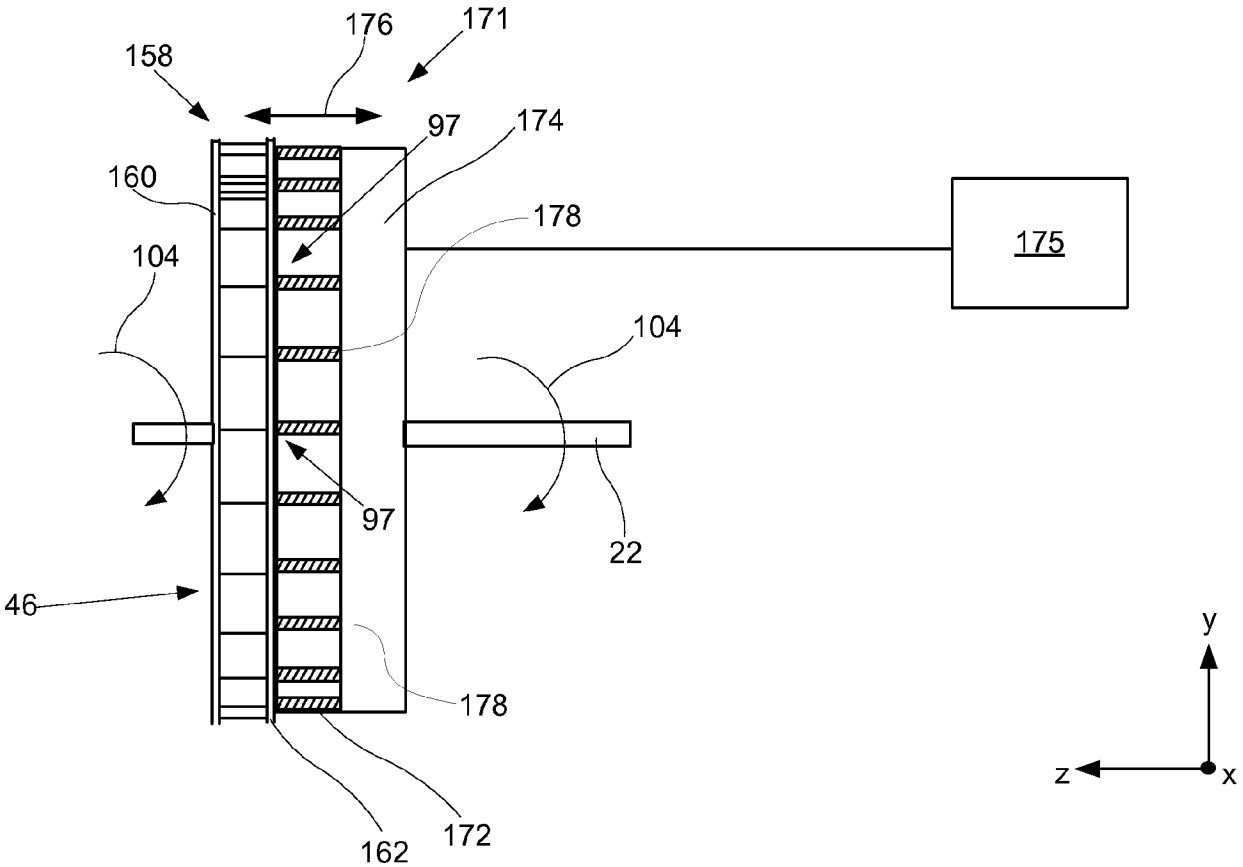
FIG. 7 is a side view of a supersonic compressor startup support system that includes an axially translatable fluid flow control device and a first positioning device that may be used with the supersonic compressor rotor shown in FIG. 6.

FIG. 7 is a side view of a supersonic compressor startup support system 171. In the exemplary embodiment, system 171 includes an axially translatable fluid flow control device 172 and a first positioning device 174 that may be used with supersonic compressor rotor 158. For purposes of clarity, FIG. 7 shows the x-axis directed into the page, that is, supersonic compressor rotor 158 as shown in FIG. 6 is rotated approximately 45 degrees about the y-axis toward a viewer. In the exemplary embodiment, first positioning device 174 is any clutch-type mechanism that enables operation of axially translatable fluid flow control device 172 as described herein including, without limitation, a pressure plate clutch, a magnetic clutch, and a hydraulic clutch. First positioning device 174 is biased to shift axially translatable fluid flow control device 172 away from supersonic compressor rotor 158 and overcomes such bias to shift axially translatable fluid flow control device 172 toward supersonic compressor rotor 158, both movements towards and away rotor 158 as shown by axial translation arrow 176.

Also, in the exemplary embodiment, first positioning device 174 is rotatably coupled to drive shaft 22. Axially translatable fluid flow control device 172 is operatively coupled to first positioning device 174 and is rotationally coupled to drive shaft 22.

First positioning device 174 is operatively coupled to a control system 175 within supersonic compressor startup support system 171. Control system 175 is programmed with sufficient analog and discrete logic, including algorithms, and implemented in a manner that facilitates operation of supersonic compressor system 10 (shown in FIG. 1), including first positioning device 174, as described herein. In the exemplary embodiment, control system 175 includes at least one processor including, without limitation, those processors resident within personal computers, remote servers, programmable logic controllers (PLCs), and distributed control system (DCS) cabinets.

During operation, drive shaft 22 rotates as indicated by directional arrows 104 and first positioning device 174 and fluid flow control device 172 are rotating in synchronism with supersonic compressor rotor 158. Upon engagement of first positioning device 174, first positioning device 174 axially translates fluid flow control device 172 towards supersonic compressor rotor 158. Upon disengagement of first positioning device 174, first positioning device 174 axially translates fluid flow control device 172 away from supersonic compressor rotor 158.

Further, in the exemplary embodiment, fluid flow control device 172 includes at least one axially translatable member, or protrusion 178. Each axially translatable protrusion 178 is sized, configured, and oriented to be at least partially insertable into flow channel 80, and more specifically, throat region 124. Also, axially translatable fluid flow control device 172 is coupled directly to second endwall 162 that defines a plurality of openings (not shown) sized, oriented, and configured to receive axially translatable protrusions 178 during operation of supersonic compressor rotor 158. Fluid flow control device 172 and axially translatable protrusions 178 are described further below.

Moreover, in the exemplary embodiment, a single fluid flow control device 172 is adjacent to second endwall 162. Alternatively, fluid flow control device 172 and associated first positioning device 174 are positioned adjacent first endwall 160. Also, alternatively, fluid flow control device 172 and associated first positioning device 174 are positioned adjacent each of first endwall 160 and second endwall 162. In the alternative embodiments, both fluid flow control devices 172 and associated first positioning devices 174 may be operated in unison or individually.

Figure 8:
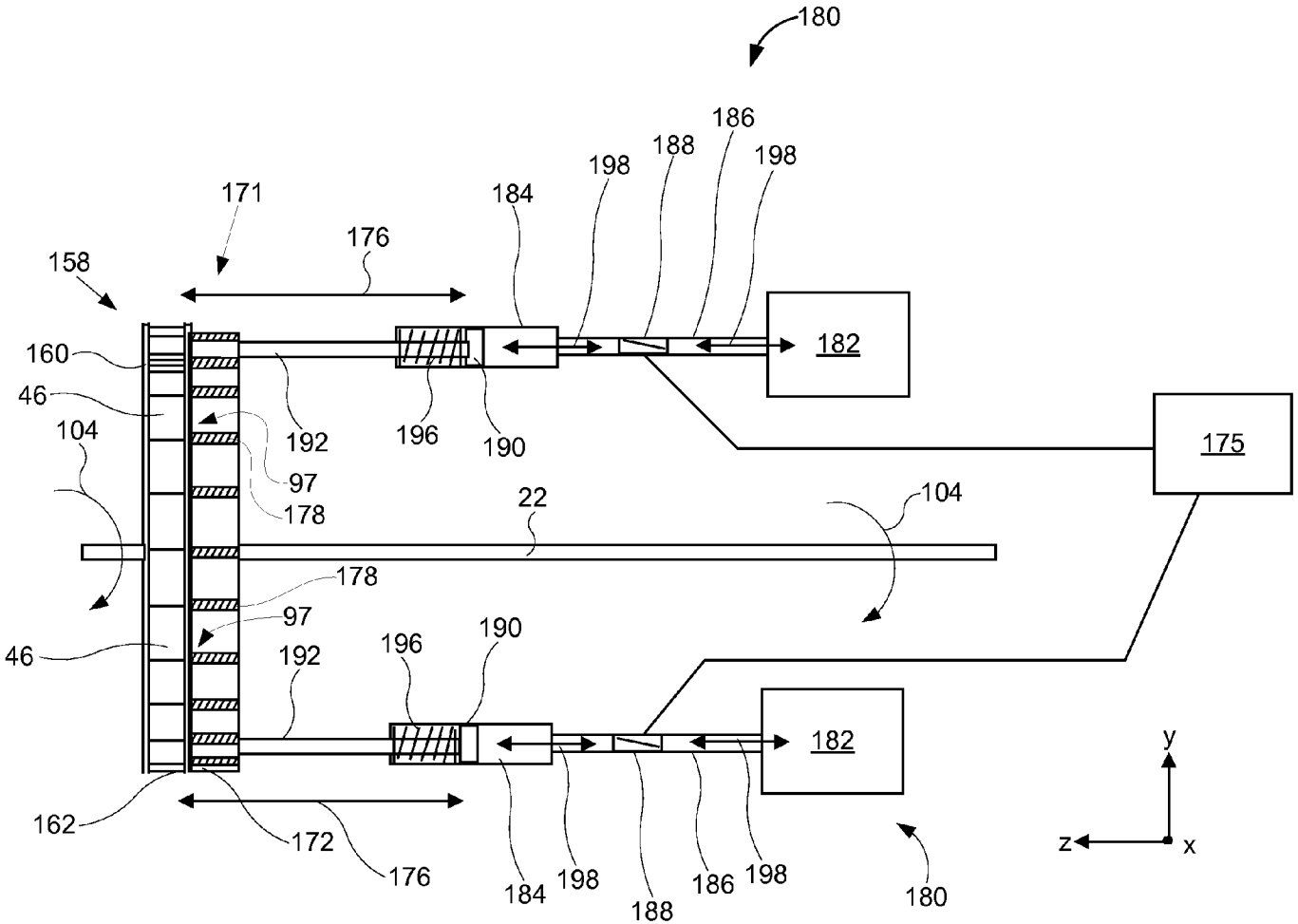
FIG. 8 is a side view of an axially translatable fluid flow control device and a second positioning device that may be used with the supersonic compressor rotor shown in FIG. 6.

FIG. 8 is a side view of axially translatable fluid flow control device 172 and a second positioning device 180 that may be used with supersonic compressor rotor 158. Similar to FIG. 7, FIG. 8 shows the x-axis directed into the page. Second positioning device 180 is at least one hydraulic piston-type mechanism, wherein, in the exemplary embodiment, two second positioning devices 180 are shown. Both of second positioning devices 180 may operate in unison or individually, and one of second positioning devices 180 may utilized as a redundant, or backup device.

In the exemplary embodiment, each second positioning device 180 includes a hydraulic fluid source, or reservoir 182. Each second positioning device 180 also includes a hydraulic cylinder 184 coupled in flow communication with reservoir 182 via at least one hydraulic fluid conduit 186 and at least one hydraulic fluid flow control valve 188 (only one of each shown for each second positioning device 180). Reservoir 182 is filled with a predetermined volume of hydraulic fluid (not shown) at a predetermined pressure. Each second positioning device 180 further includes a hydraulic piston 190 positioned within hydraulic cylinder 184. Moreover, each hydraulic piston 190 is operatively coupled to axially translatable fluid flow control device 172 via position control member, or rod 192. Also, in the exemplary embodiment, each hydraulic fluid flow control valve 188 is operatively coupled to control system 175 that enables positioning of valves 188 to channel hydraulic fluid to and from reservoirs 182 and hydraulic cylinders 184. Each hydraulic cylinder 184 also includes a biasing mechanism 196, such as a spring, to bias second positioning device 180 to shift axially translatable fluid flow control device 172 away from supersonic compressor rotor 158. Hydraulic fluid channeled to hydraulic cylinder 184 overcomes such bias to shift axially translatable fluid flow control device 172 toward supersonic compressor rotor 158. Both movements are shown by axial translation arrows 176.

Further, in the exemplary embodiment, each second positioning device 180 is operatively coupled to axially translatable fluid flow control device 172. Axially translatable fluid flow control device 172 is rotationally coupled to drive shaft 22. Therefore, each second positioning device 180 is configured to rotate with fluid flow control device 172.

During operation, drive shaft 22 rotates as indicated by directional arrows 104 and second positioning device 180 rotates in synchronism with supersonic compressor rotor 158 and axially translatable fluid flow control device 172. Upon actuation of second positioning device 180, hydraulic fluid is channeled from reservoir 182 to hydraulic cylinder 184 via channel 186 and at least partially opens hydraulic fluid flow control valve 188 at a predetermined flow rate and pressure. Such fluid flow is shown by hydraulic flow arrows 198. As pressure increases against hydraulic piston 190, a force is induced thereon and as bias induced by bias mechanism 196 is overcome, hydraulic piston 190 and position control rod 192 axially translate fluid flow control device 172 towards supersonic compressor rotor 158. Upon deactivation of second positioning device 180, hydraulic fluid flow control valve 188 at least partially closes, thereby decreasing the force induced on hydraulic piston 190 such that biasing mechanism 196 induces sufficient force on hydraulic piston 190 to channel hydraulic fluid back into reservoir 182 (such fluid flow is also shown by hydraulic flow arrows 198) and axially translate fluid flow control device 172 away from supersonic compressor rotor 158.

Moreover, in the exemplary embodiment, a single fluid flow control device 172 is adjacent second endwall 162. Alternatively, fluid flow control device 172 and associated second positioning device 174 are positioned adjacent to first endwall 160. Also, alternatively, fluid flow control device 172 and associated second positioning device 174 are positioned adjacent each of first endwall 160 and second endwall 162. In the alternative embodiments, both fluid flow control devices 172 and associated second positioning devices 180 may be operated in unison or individually.

Figure 9:
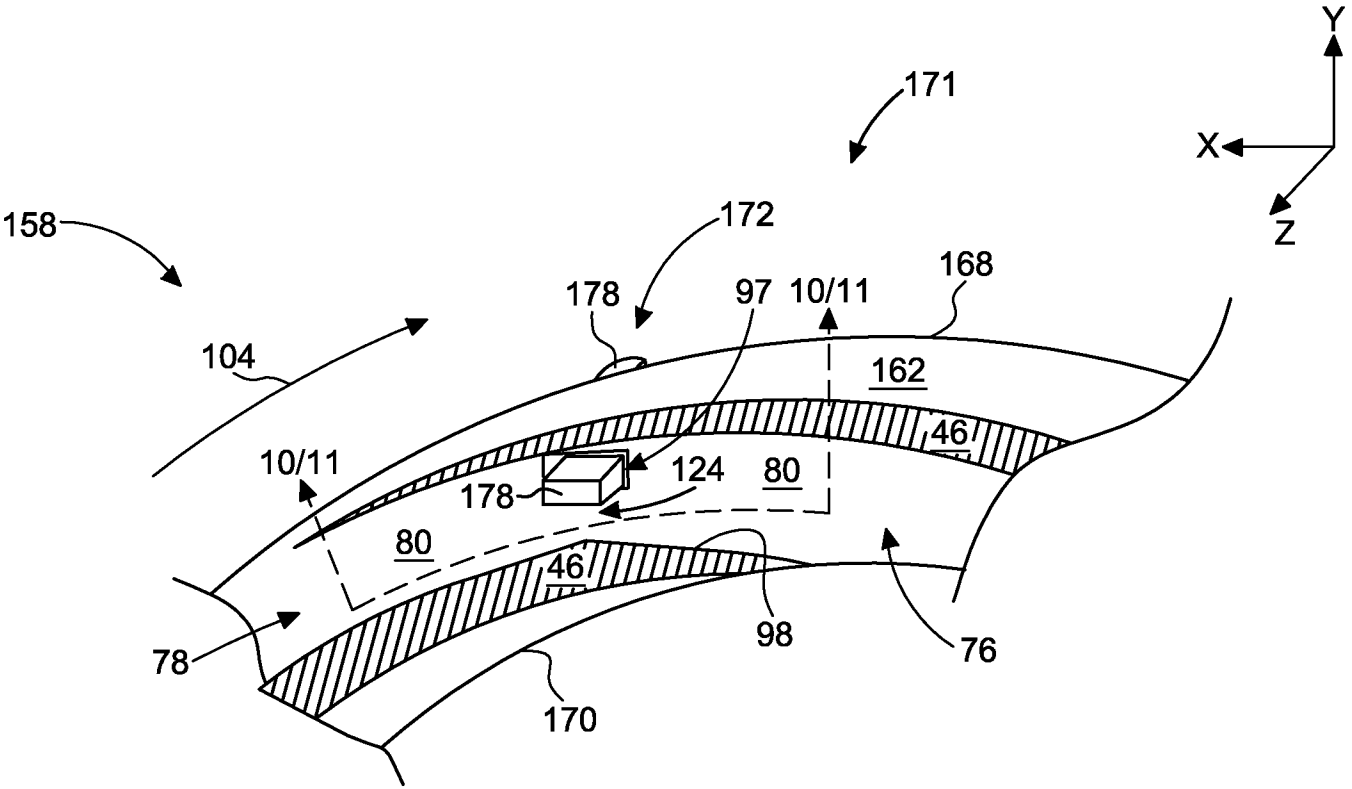
FIG. 9 is a cross-sectional perspective view of a portion of the axially translatable fluid flow control device and a portion of the supersonic compressor rotor shown in FIGS. 7 and 8.

FIG. 9 is a cross-sectional perspective view of a portion of axially translatable fluid flow control device 172 and a portion of supersonic compressor rotor 158. For purposes of clarity, only a portion of axially translatable fluid control device 172 is shown in FIG. 9. In the exemplary embodiment, an axially translatable member, or protrusion 178 is shown at least partially extended through second endwall 162 and at least partially inserted into flow channel 80 between two adjacent vanes 46. More specifically, protrusion 178 is shown at least partially extended through penetration 97 into throat region 124. Protrusion 178 is substantially sized and shaped to facilitate further restriction, or obstruction of flow, at least partially, in throat region 124 of channel 80 while mitigating contact with any portion of vanes 46, including compression ramp 98, second inner periphery 170 of second endwall 162, and second outer periphery 168 of endwall 162. Protrusion 178 is fabricated from any material that enables operation of axially translatable fluid flow control device 172 as described herein.

Figure 10:
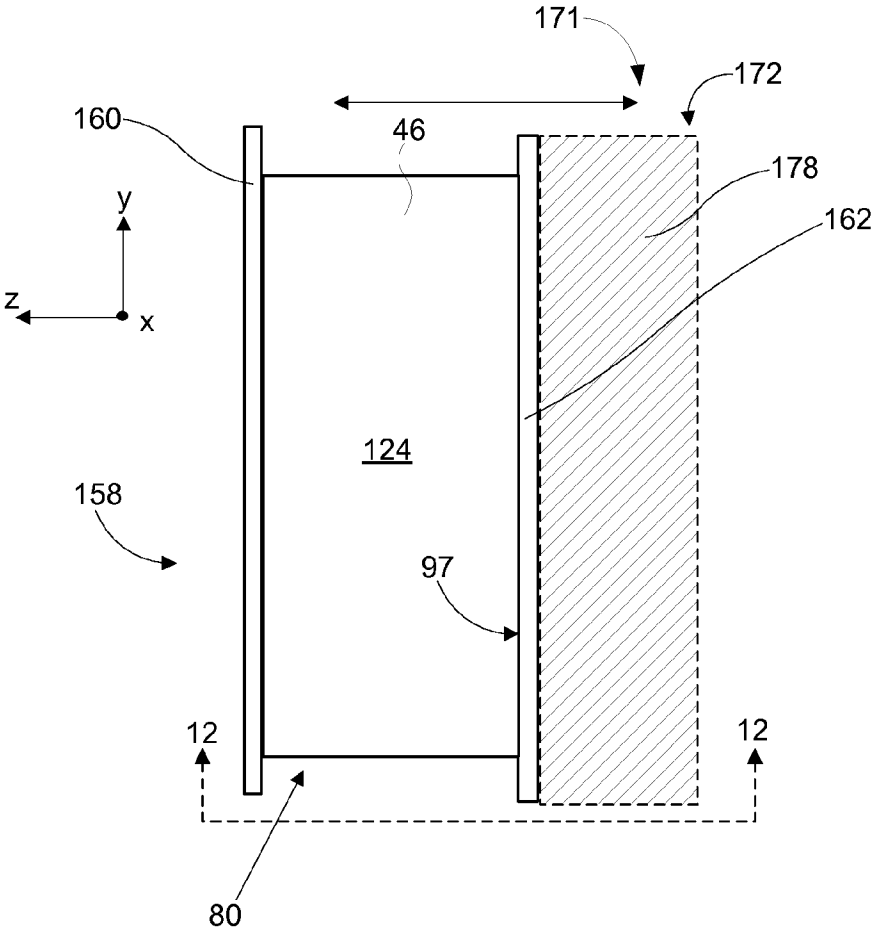
FIG. 10 is a cross-sectional view of a portion of the axially translatable fluid flow control device and a portion of the supersonic compressor rotor shown in FIG. 9 and taken along line 10-10.

FIG. 10 is a cross-sectional view of a portion of axially translatable fluid flow control device 172 and a portion of supersonic compressor rotor 158 taken along line 10-10 as shown in FIG. 9. More specifically, FIG. 10 shows axially translatable protrusion 178 fully retracted through penetration 97 of second endwall 162 and fully extracted from throat region 124 of flow channel 80. For purposes of clarity, FIG. 10 shows the x-axis directed into the page and compression ramp 98 is not shown.

Figure 11:
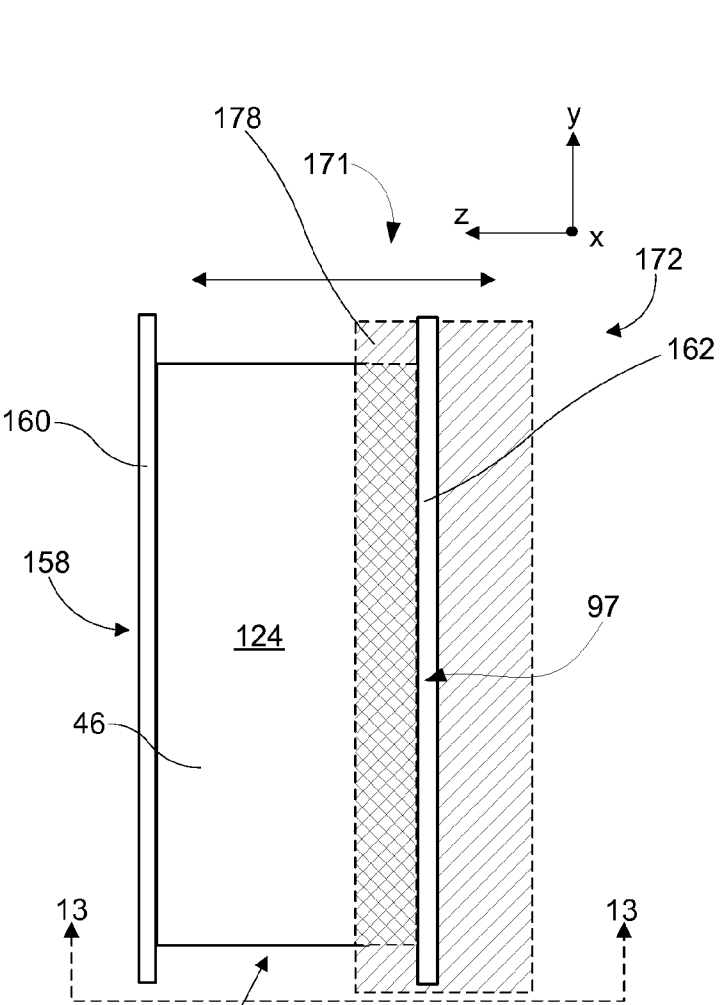
FIG. 11 is a cross-sectional view of a portion of the axially translatable fluid flow control device and a portion of the supersonic compressor rotor shown in FIG. 9 and taken along line 11-11.

FIG. 11 is a cross-sectional view of a portion of axially translatable fluid flow control device 172 and a portion of supersonic compressor rotor 158 taken along line 11-11 shown in FIG. 9. More specifically, FIG. 11 shows axially translatable protrusion 178 at least partially extended through penetration 97 of second endwall 162 and at least partially inserted into throat region 124 of flow channel 80. For purposes of clarity, FIG. 11 shows the x-axis entering into the page and compression ramp 98 is not shown.

Figure 12:
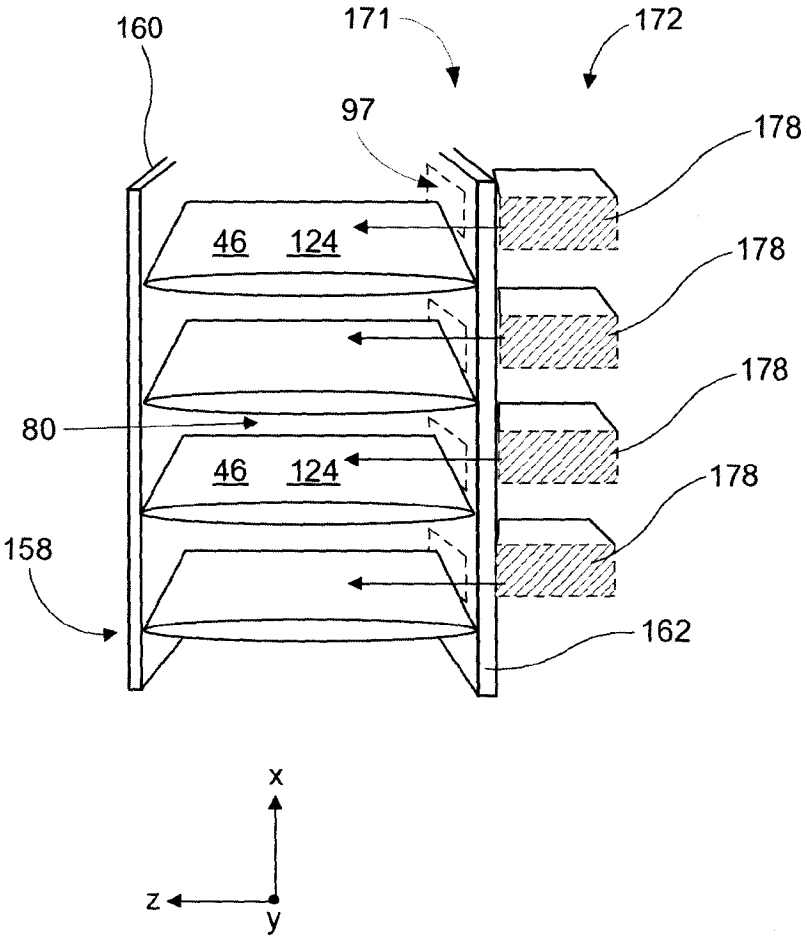
FIG. 12 is a cross-sectional view of a portion of the axially translatable fluid flow control device and a portion of the supersonic compressor rotor shown in FIG. 10 and taken along line 12-12.

FIG. 12 is a cross-sectional view of a portion of axially translatable fluid flow control device 172 and a portion of supersonic compressor rotor 158 taken along line 12-12 shown in FIG. 10. More specifically, FIG. 12 shows axially translatable protrusion 178 fully retracted through penetration 97 of second endwall 162 and fully extracted from throat region 124 of flow channel 80. For purposes of clarity, FIG. 12 shows the y-axis directed into the page and compression ramp 98 is not shown.

Figure 13:
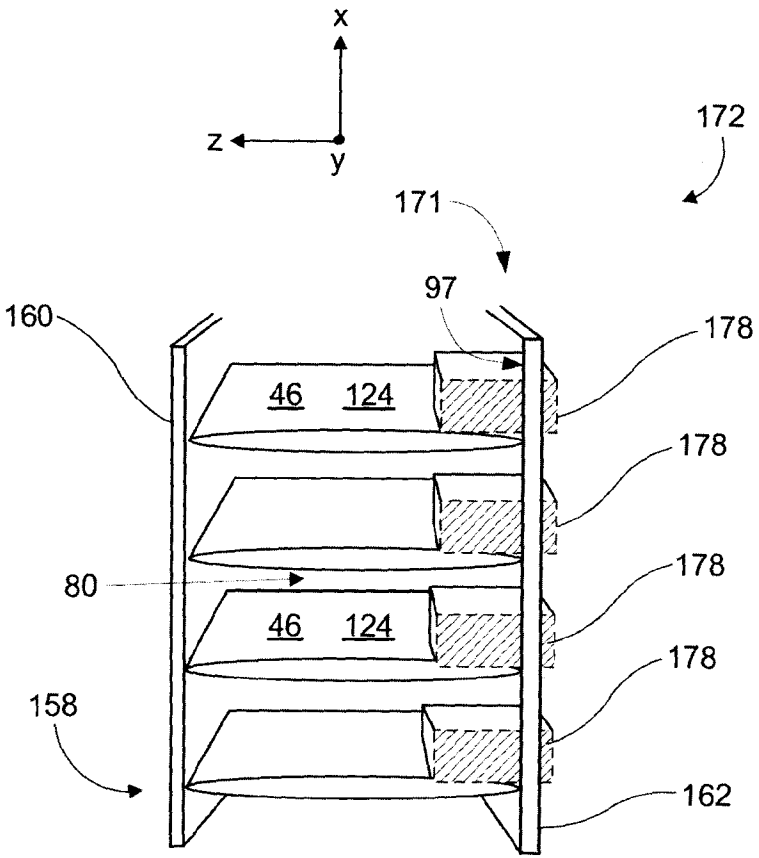
FIG. 13 is a cross-sectional view of a portion of the axially translatable fluid flow control device and a portion of the supersonic compressor rotor shown in FIG. 11 and taken along line 13-13.

FIG. 13 is a cross-sectional view of a portion of axially translatable fluid flow control device 172 and a portion of supersonic compressor rotor 158 taken along line 13-13 shown in FIG. 11. More specifically, FIG. 13 shows axially translatable protrusion 178 partially inserted through penetration 97 of second endwall 162 into throat region 124 of flow channel 80. For purposes of clarity, FIG. 13 shows the y-axis directed into the page and compression ramp 98 is not shown.

FIGS. 10-13 show substantially planar vanes 46 and substantially planar/rectangular axially translatable protrusions 178 to facilitate depiction and description thereof. Vanes 46 and axially translatable protrusions 178 have any size, shape, configuration, and orientation that enables operation of supersonic compressor rotor 158 as described herein. Moreover, penetrations 97 will also have any size, shape, configuration, and orientation that enables operation of supersonic compressor rotor 158 as described herein. Moreover, any sealing arrangements to mitigate fluid losses through such penetrations that enable operation of supersonic compressor rotor 158 as described herein are used.

In general, during starting operations of supersonic compressors, a first predetermined throat opening is used to facilitate low initial fluid flow velocities at low rotational velocities of the supersonic compressor rotor. As the supersonic compressor is rotationally accelerated, the inlet Mach number of the fluid rises gradually as the rotor speed increases gradually. Also, as the inlet Mach number of the fluid flow increases, a predetermined throat area that facilitates proper formation and maintenance of the oblique and normal shocks decreases. Therefore, an ideal throat area required at low supersonic speeds is higher than an ideal throat area required at high supersonic speeds.

Referencing FIGS. 10-13 together, during starting operations of supersonic compressor rotor 158, axially translatable protrusions 178 of supersonic compressor startup support system 171 are fully retracted from throat region 124, as shown in FIGS. 10 and 12, and throat region 124 is fully open and has a first predetermined throat area. As supersonic compressor rotor 158 is accelerated, axially translatable protrusions 178 are partially inserted into throat region 124, as shown in FIGS. 11 and 13, and an area of throat region 124 is reduced compared to the first throat area, thereby providing a variable throat area. Axially translatable protrusions 178 may be inserted, and extracted, by control system 175 (shown in FIGS. 7 and 8) based on a plurality of variables that include, without limitation, rotor speed, mass fluid flow rates, fluid discharge pressures, and temporal parameters.

In the exemplary embodiment, axially translatable protrusions 178 have a sufficient radial length to facilitate predetermined air flow characteristics throughout flow channel 80. Alternatively, axially translatable protrusions 178 have any length that enables operation of supersonic compressor rotor 158 as described herein.

In the exemplary embodiment, decreasing the throat area with a variable throat geometry configuration as described herein facilitates adjusting the throat area-to-inlet area ratio values by modulating the throat area value. Therefore, for a given Mach number of the supersonic fluid flow, a predetermined ratio for a predetermined efficiency and predetermined pressure loss may be attained by modulating the throat area accordingly.

The above-described supersonic compressor rotor provides a cost effective and reliable method for increasing an efficiency in performance of supersonic compressor systems during starting operations. Moreover, the supersonic compressor rotor facilitates increasing the operating efficiency of the supersonic compressor system by reducing pressure losses across a normal shockwave. More specifically, the supersonic compression rotor includes a variable throat geometry that facilitates formation and maintenance of normal shockwaves in a proper position within a fluid flow channel. Also, more specifically, the above-described supersonic compressor rotor includes a fluid control device that is modulated to vary a size of the throat area during starting operations and at other times as conditions may require.

Exemplary embodiments of systems and methods for starting a supersonic compressor rotor are described above in detail. The system and methods are not limited to the specific embodiments described herein, but rather, components of systems and/or steps of the method may be utilized independently and separately from other components and/or steps described herein. For example, the systems and methods may also be used in combination with other rotary engine systems and methods, and are not limited to practice with only the supersonic compressor system as described herein. Rather, the exemplary embodiment can be implemented and utilized in connection with many other rotary system applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A supersonic compressor comprising:

at least one fluid inlet;

at least one fluid outlet;

a fluid conduit extending between said fluid inlet and said fluid outlet;

at least one supersonic compressor rotor disposed within said fluid conduit, said rotor comprising:

a first endwall;

a plurality of vanes coupled to said first endwall, each pair of said plurality of vanes defining a fluid flow channel extending therethrough, said fluid flow channel defining a flow channel inlet opening and a flow channel outlet opening, said fluid flow channel comprising a throat portion; and a second endwall; and at least one axially translatable fluid control device positioned adjacent to said rotor configured to at least partially obstruct said throat portion, said at least one axially translatable fluid control device comprising:

at least one axially translatable protrusion insertable into at least a portion of said throat portion.

2. The supersonic compressor according to claim 1, wherein said axially translatable fluid control device is movable from a first position during a first operational mode of said supersonic compressor to a second position during a second operational mode of said supersonic compressor.

3. The supersonic compressor according to claim 2, wherein said first position comprises a fully retracted position of said axially translatable fluid control device with respect to said fluid flow channel during a starting mode of operation of said supersonic compressor.

4. The supersonic compressor according to claim 2, wherein said second position comprises a partially retracted position of said axially translatable fluid control device with respect to said fluid flow channel during a post-starting mode of operation of said supersonic compressor.

5. The supersonic compressor according to claim 1, wherein said axially translatable fluid control device further comprises an axial positioning device coupled to said axially translatable protrusion.

6. The supersonic compressor according to claim 1, wherein said at least one axially translatable protrusion comprises at least one of:

a first protrusion extendable through said first endwall; and a second protrusion extendable through said second endwall.

7. The supersonic compressor according to claim 1 comprising at least two counter-rotating supersonic compressor rotors.

8. A startup support system for a supersonic compressor, the supersonic compressor including at least one fluid inlet, at least one fluid outlet, a fluid conduit extending therebetween, at least one supersonic compressor rotor disposed within the fluid conduit, and a flow channel inlet opening and a flow channel outlet opening and a throat portion therebetween, said startup support system comprising:

at least one axially translatable fluid control device positioned adjacent to the rotor, said axially translatable fluid control device configured to at least partially obstruct fluid flow through the throat portion, said at least one axially translatable fluid control device comprising:

at least one axially translatable protrusion insertable into at least a portion of the throat portion.

9. The startup support system according to claim 8, wherein said axially translatable fluid control device is movable from a first position during a first operational mode of the supersonic compressor to a second position during a second operational mode of the supersonic compressor.

10. The startup support system according to claim 9, wherein said first position during a first operational mode of the supersonic compressor comprises a fully retracted position of said axially translatable fluid control device during a starting mode of operation of the supersonic compressor.

11. The startup support system according to claim 9, wherein said second position comprises a partially retracted position of said axially translatable fluid control device during a post-starting mode of operation of the supersonic compressor.

12. The startup support system according to claim 8, wherein said axially translatable fluid control device further comprises an axial positioning device coupled to said axially translatable protrusion.

13. The startup support system according to claim 8, wherein said at least one axially translatable protrusion comprises at least one of:

a first protrusion extendable through a first endwall; and a second protrusion extendable through a second endwall.

14. The startup support system according to claim 8, wherein said supersonic compressor system comprises at least two counter-rotating supersonic compressor rotors.

15. A method for starting a supersonic compressor, said method comprising:

providing a supersonic compressor including:

a fluid inlet coupled in fluid communication with at least one fluid source;

a fluid outlet;

at least one supersonic compressor rotor including:

a first endwall;

a plurality of vanes coupled to the first endwall, each pair of the plurality of vanes defining a fluid flow channel extending therethrough, the fluid flow channel defining a flow channel inlet opening and a flow channel outlet opening, the fluid flow channel comprising a throat portion;

a second endwall; and at least one axially translatable fluid control device positioned adjacent to the at least one supersonic compressor rotor configured to at least partially obstruct the throat portion, the at least one axially translatable fluid control device including:

at least one axially translatable protrusion insertable into at least a portion of the throat portion; and axially moving the at least one axially translatable fluid control device to a first position that substantially opens the throat portion during a starting mode of operation of the supersonic compressor.

16. The method according to claim 15, wherein axially moving the at least one axially translatable fluid control device to a first position comprises at least one of:

extracting a first protrusion extending through the first endwall from the fluid flow channel defined between the pair of the plurality of vanes to open the throat portion; and extracting a second protrusion extending through the second endwall from the fluid flow channel defined between the pair of the plurality of vanes to open the throat portion.

17. The method according to claim 15, wherein providing a supersonic compressor including at least one supersonic compressor rotor comprises providing a supersonic compressor including two counter-rotating supersonic compressor rotors.

18. The method according to claim 15 further comprising axially moving the at least one axially translatable fluid control device to a second position that at least partially obstructs the throat portion during a post-starting mode of operation of the supersonic compressor.

19. The method according to claim 18, wherein axially moving the at least one axially translatable fluid control device to a second position comprises at least one of:

inserting a first protrusion through the first endwall at least partially into the fluid flow channel defined between the pair of the plurality of vanes to at least partially obstruct the throat portion; and inserting a second protrusion through the second endwall at least partially into the fluid flow channel defined between the pair of the plurality of vanes to at least partially obstruct the throat portion.

20. The method according to claim 15 further comprising channeling at least one of a gas mixture and a gas-liquid mixture from the fluid source to the throat portion.

* * * * *